US009424978B2

(12) United States Patent
Duval

(10) Patent No.: US 9,424,978 B2
(45) Date of Patent: Aug. 23, 2016

(54) MAGNETICALLY SHIELDED THREE PHASE ROTARY TRANSFORMER HAVING THREE MAGNETIC CORES

(71) Applicant: LABINAL POWER SYSTEMS, Blagnac (FR)

(72) Inventor: Cedric Duval, Samois sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 0 days.

(21) Appl. No.: 14/400,163

(22) PCT Filed: May 3, 2013

(86) PCT No.: PCT/FR2013/050987
§ 371 (c)(1),
(2) Date: Nov. 10, 2014

(87) PCT Pub. No.: WO2013/167830
PCT Pub. Date: Nov. 14, 2013

(65) Prior Publication Data

US 2015/0145626 A1 May 28, 2015

(30) Foreign Application Priority Data

May 10, 2012 (FR) ..... 12 54298

(51) Int. Cl.
*H01F 21/06* (2006.01)
*H01F 30/12* (2006.01)
(Continued)

(52) U.S. Cl.
CPC ..... *H01F 27/24* (2013.01); *H01F 27/255* (2013.01); *H01F 27/2823* (2013.01); *H01F 30/12* (2013.01); *H01F 38/18* (2013.01)

(58) Field of Classification Search
CPC ..... H01F 27/24; H01F 27/2823; H01F 30/12; H01F 38/18
USPC ..... 336/5, 10, 115, 119, 125, 126, 130, 336/131, 178, 170, 212
See application file for complete search history.

(56) References Cited

U.S. PATENT DOCUMENTS 5,347,256 A * 9/1994 Yumiki ..... H01F 38/18 336/120
2011/0050377 A1 3/2011 Bjerknes et al.
2015/0137924 A1* 5/2015 Duval ..... H01F 30/12 336/10

FOREIGN PATENT DOCUMENTS

DE 199 53 583 12/2001
EP 0 688 028 12/1995
JP 2008-245484 10/2008

OTHER PUBLICATIONS

International Search Report issued Aug. 12, 2013 in PCT/FR13/050987 filed May 3, 2013.

*Primary Examiner* — Mangtin Lian
(74) *Attorney, Agent, or Firm* — Oblon, McClelland, Maier & Neustadt, L.L.P.

(57) ABSTRACT

A three-phase transformer including a primary portion and a secondary portion, the primary portion including a first body made of ferromagnetic material and primary coils, the secondary portion including a second body made of ferromagnetic material and secondary coils, the first body defining a first annular slot of axis A and a second annular slot of axis A, the primary coils including a first toroidal coil of axis A in the first slot, a second toroidal coil of axis A in the second slot, and one or more third toroidal coils connected in series, the third coils being wound around one of the legs, and passing via slots in the leg.

9 Claims, 7 Drawing Sheets

(51) Int. Cl.

| | | | |
|---|---|---|---|
| ***H01F 17/06*** | (2006.01) | ***H01F 38/18*** | (2006.01) |
| ***H01F 27/24*** | (2006.01) | ***H01F 27/28*** | (2006.01) |
| | | ***H01F 27/255*** | (2006.01) |

FIG.11
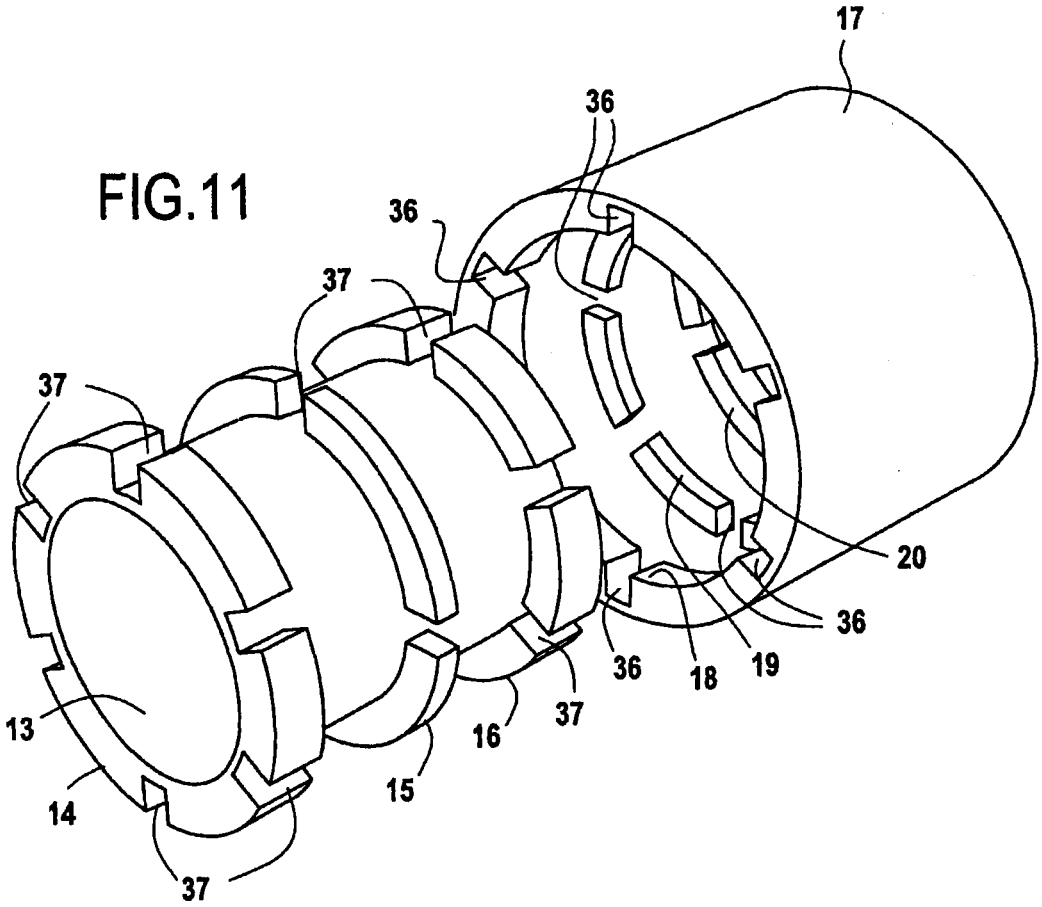
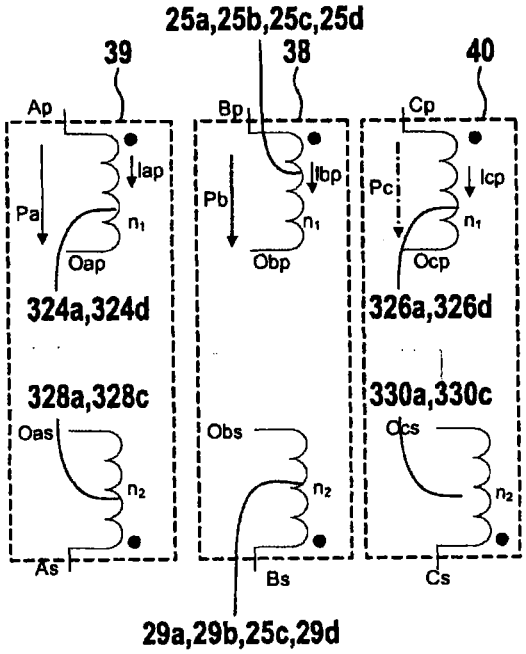
FIG.12

MAGNETICALLY SHIELDED THREE PHASE ROTARY TRANSFORMER HAVING THREE MAGNETIC CORES

BACKGROUND OF THE INVENTION

The present invention relates to the general field of transformers. In particular, the invention relates to a rotary three-phase transformer.

A rotary three-phase transformer serves to transfer energy and/or signals without contact between two axes rotating one relative to the other.

FIGS. 1 and 2 show respective rotary three-phase transformers 1 of the prior art.

The transformer 1 has three rotary single-phase transformers 2 corresponding to phases U, V, and W. Each rotary single-phase transformer 2 has a portion 3 and a portion 4 rotating one relative to the other about an axis A. By way of example, the portion 3 is a stator and the portion 4 is a rotor, or vice versa. In a variant, the portion 3 and the portion 4 are both movable in rotation relative to a stationary frame of reference (not shown). A toroidal coil 5 is received in a slot 6 defined by a body made of ferromagnetic material of the portion 3. A toroidal coil 7 is received in a slot 8 defined by a body made of ferromagnetic material of the portion 4. For each rotary single-phase transformer 2, the coils 5 and 7 form primary and secondary coils (or vice versa).

FIG. 1 shows a variant referred to as "U-shaped" in which the portion 3 surrounds the portion 4 about the axis A, while FIG. 2 shows a variant referred to as "E-shaped" or "pot-shaped", in which the portion 3 and the portion 4 are one beside the other in the axial direction.

The three-phase transformer 1 of FIG. 1 or 2 presents weight and volume that are large since it is not possible to make best use of the magnetic fluxes of each of the phases, unlike a static three-phase transformer with forced fluxes in which it is possible to couple the fluxes. Furthermore, in the example of FIG. 2, it is necessary to use electrical conductors of sections that differ as a function of the distance between the axis of rotation and the phase, in order to conserve balanced resistances.

Document US 2011/0050377 describes a four-column rotary three-phase transformer. That transformer presents considerable weight and volume. That document also describes a five-column rotary three-phase transformer. That transformer presents considerable weight and volume. Furthermore, it makes use of radial winding passing via slots in the central columns of the magnetic circuit, where such winding is more complex to perform than the toroidal winding used in the transformers of FIGS. 1 and 2.

There thus exists a need to improve the topology of a three-phase transformer.

OBJECT AND SUMMARY OF THE INVENTION

The invention provides a three-phase transformer having a primary portion and a secondary portion;

the primary portion comprising a first body made of ferromagnetic material and primary coils, the secondary portion comprising a second body made of ferromagnetic material and secondary coils;

the first body defining a first annular slot of axis A and a second annular slot of axis A, the first slot being defined by a first side leg, a central leg, and a ring, the second slot being defined by the central leg, a second side leg, and the ring; and the primary coils comprise a first toroidal coil of axis A in the first slot, a second toroidal coil of axis A in the second slot, and one or more third coils connected in series, said third coils being wound around one of said legs and passing in the slots in said leg.

In this transformer, if three-phase currents are caused to flow in the primary coils in directions that are appropriate, given the directions of the primary coils, then the magnetic potentials of the first, second, and third primary coils are directed towards or away from a common point, thereby leading to the fluxes being coupled. This enables the transformer to be of reduced dimensions in terms of volume and weight. Furthermore, the primary of the transformer makes use in part of simple toroidal coils of axis A, thus enabling its structure to be particularly simple.

In an embodiment, said third coils are wound around said central leg.

In an embodiment, the primary portion and the secondary portion are movable in rotation relative to each other about the axis A.

Under such circumstances, the invention provides a rotary three-phase transformer that, by virtue of its fluxes being coupled, presents weight and volume that are reduced, in particular relative to using three single-phase rotary transformers.

In an embodiment, the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring;

the secondary coils comprise a first toroidal secondary coil of axis A in the first secondary slot, a second toroidal secondary coil of axis A in the second secondary slot, and one or more third secondary coils connected in series, said third secondary coils being wound around one of said secondary legs and passing via slots in said secondary leg.

In this embodiment, the secondary is made on the same principle as the primary. The secondary thus also contributes to limiting the weight and the volume of the transformer, and enables the transformer to be constructed while using only toroidal coils of axis A.

In an embodiment, the secondary is made on a principle that differs from that of the primary. For example, it makes use, for each phase, of one or more coils surrounding the corresponding leg.

In an embodiment, the first side leg and the first secondary side leg are in line with each other and separated by an airgap, the first central leg and the first secondary central leg are in line with each other and separated by an airgap, and the second side leg and the second secondary side leg are in line with each other and separated by an airgap.

The primary portion may surround the secondary portion relative to the axis A, or vice versa. That corresponds to making a transformer that is referred to as being "U-shaped".

The primary portion and the secondary portion may be situated one beside the other in the direction of the axis A. That corresponds to making a transformer that is referred to as being "E-shaped" or "pot-shaped".

In an embodiment, the primary portion and the secondary portion are stationary relative to each other. A static transformer in accordance with the invention presents the same advantages as a rotary transformer in accordance with the invention.

In an embodiment, the first and second bodies made of ferromagnetic material completely surround the primary and the secondary coils.

Under such circumstances, the transformer is magnetically shielded.

BRIEF DESCRIPTION OF THE DRAWINGS

Other characteristics and advantages of the present invention appear from the following description made with reference to the accompanying drawings, which show implementations having no limiting character. In the figures:

FIG. 11 is an exploded perspective view of the magnetic circuit of the FIG. 10 transformer;

FIG. 12 is an electrical circuit diagram showing the operation of the FIG. 10 transformer;

DETAILED DESCRIPTION OF EMBODIMENTS

Figure 3:
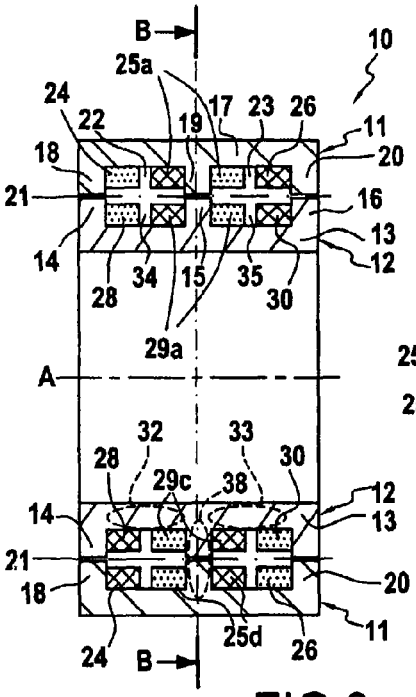
FIGS. 3 and 4 are section views of a magnetically shielded three-phase rotary transformer with forced linked fluxes in a first embodiment of the invention.
Figure 4:
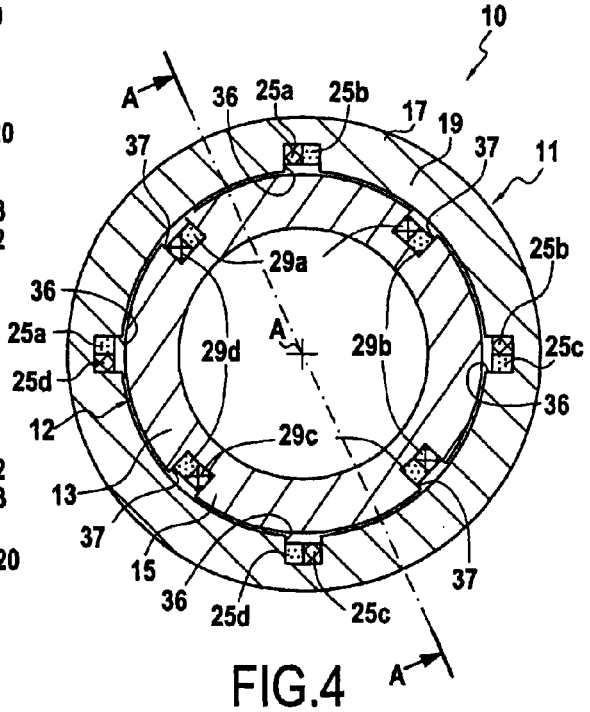

FIGS. 3 and 4 are section views of a transformer 10 in a first embodiment of the invention. The transformer 10 is a magnetically shielded three-phase rotary transformer with forced linked fluxes.

The transformer 10 comprises a portion 11 and a portion 12 that are suitable for rotating relative to each other about an axis A. By way of example, the portion 11 is a stator and the portion 12 is a rotor, or vice versa. In a variant, the portion 11 and the portion 12 are both movable in rotation relative to a stationary frame of reference (not shown).

The portion 12 comprises a ring 13 of axis A and three legs 14, 15, and 16 made of ferromagnetic material. Each of the legs 14, 15, and 16 extends radially away from the axis A, starting from the ring 13. The leg 14 is at one end of the ring 13, the leg 16 is at another end of the ring 13, and the leg 15 lies between the legs 14 and 16. The ring 13 and the legs 14 and 15 define an annular slot 34 that is open in a radially outward direction. The ring 13 and the legs 15 and 16 define an annular slot 35 that is open in a radially outward direction. In general manner, the ring 13 and the legs 14, 15, and 16 form a body of ferromagnetic material defining two annular slots 34 and 35 that are open in a radially outward direction.

The portion 11 comprises a ring 17 of axis A and three legs 18, 19, and 20 made of the ferromagnetic material. The ring 17 surrounds the ring 13. Each of the legs 18, 19, and 20 extends radially towards the axis A, starting from the ring 17. The leg 18 is at one end of the ring 17, the leg 20 is at another end of the ring 17, and the leg 19 lies between the legs 18 and 20. The ring 17 and the legs 18 and 19 define an annular slot 22 that is open in a radially inward direction. The ring 17 and the legs 19 and 20 define an annular slot 23 that is open in a radially inward direction. In general manner, the ring 17 and the legs 18, 19, and 20 form a body of ferromagnetic material defining two annular slots 22 and 23 that are open in a radially inward direction.

The legs 14 & 18, 15 & 19, and also 16 & 20 face each other as to define an airgap 21, thereby forming the columns of the transformer 10.

The rings 13 and 17 together with the legs 14 to 16 and 18 to 20 form a magnetic circuit of the transformer 10. The transformer 10 is thus a three-column transformer. More precisely, the magnetic circuit of the transformer 10 has a first column (corresponding to the legs 14 and 18), a second column (corresponding to the legs 15 and 19), and a third column (corresponding to the legs 16 and 20).

The transformer 10 comprises coils 24, 25*a*, 25*b*, 25*c*, 25*d*, and 26 fastened to the portion 11, and coils 28, 29*a*, 29*b*, 29*c*, 29*d*, and 30 fastened to the portion 12. Below, the notation p and s is used with reference to a configuration in which the coils 24 to 26 are the primary coils of the transformer 10 and the coils 28 to 30 are the secondary coils of the transformer 10. Nevertheless, primary and secondary may naturally be inverted relative to the example described.

The coil 24 is a toroidal coil of axis A corresponding to a phase Up of the transformer 10. It is in the slot 22 and it presents $n_1$ turns.

The coils 25*a*, 25*b*, 25*c*, and 25*d* are connected in series and correspond to a phase Vp of the transformer 10. Each of the coils of 25*a*, 25*b*, 25*c*, and 25*d* surrounds a portion of the leg 19, passing via slots 36 formed in the leg 19, as shown in FIG. 4. Together, the coils 25*a*, 25*b*, 25*c*, and 25*d* present $n_1$ turns.

Finally, the coil 26 is a toroidal coil of axis A corresponding to a phase Wp of the transformer 10. It is in the slot 23 and presents $n_1$ turns.

In other words, the winding of the phases Up and Wp is annular, around the axis A, while the winding of the phase Vp takes place at a radially around the central column (corresponding to the legs 15 and 19).

The term "toroidal coil of axis A" is used to mean a coil having its turns wound around the axis A. The term "toroidal" is not used in the limited meaning referring to a solid as generated by rotating a circle about an axis. On the contrary, as in the examples shown, the section of a toroidal coil may be rectangular, in particular.

The coil 28 is a toroidal coil of axis A corresponding to a phase Up of the transformer 10. It is in the slot 34 and presents $n_2$ turns.

The coils 29*a*, 29*b*, 29*c*, and 29*d* are connected in series and correspond to a phase Vs of the transformer 10. Each of the coils 29*a*, 29*b*, 29*c*, and 29*d* surrounds a portion of the leg 15, passing via slots 37 formed in the leg 15, as shown in FIG. 4. Together, the coils 29*a*, 29*b*, 29*c*, and 29*d* present $n_2$ turns Finally, the coil 30 is a toroidal coil of axis A corresponding to a phase Ws of the transformer 10. It is in the slot 35 and presents $n_2$ turns In other words, as in the primary, the winding of the phases Us and Ws is annular, around the axis A, whereas the winding of the phase Vs takes place radially around the central column (corresponding to the legs 15 and 19).

The coils 24 and 28 surround a magnetic core 32 situated in the ring 13. The term "magnetic core" is used to mean a portion of the magnetic circuit in which the same-direction flux created by the coil is in the majority. Electric currents flowing in the coils 24 and 28 thus correspond to magnetic potentials in the magnetic core 32. In corresponding manner, the coils 26 and 30 surround a magnetic core 33 situated in the ring 13. Electric currents flowing in the coils 26 and 30 thus correspond to magnetic potentials in the magnetic core 33. Furthermore, the coils 25*a*, 25*b*, 25*c*, 25*d*, 29*a*, 29*b*, 29*c*, and 29*d* surround a magnetic core 38 situated in the central column formed by the legs 15 and 19.

The transformer 410 thus has three magnetic cores: The axial cores 32 and 33, and a radial core 38 along the central column.

Figure 5:
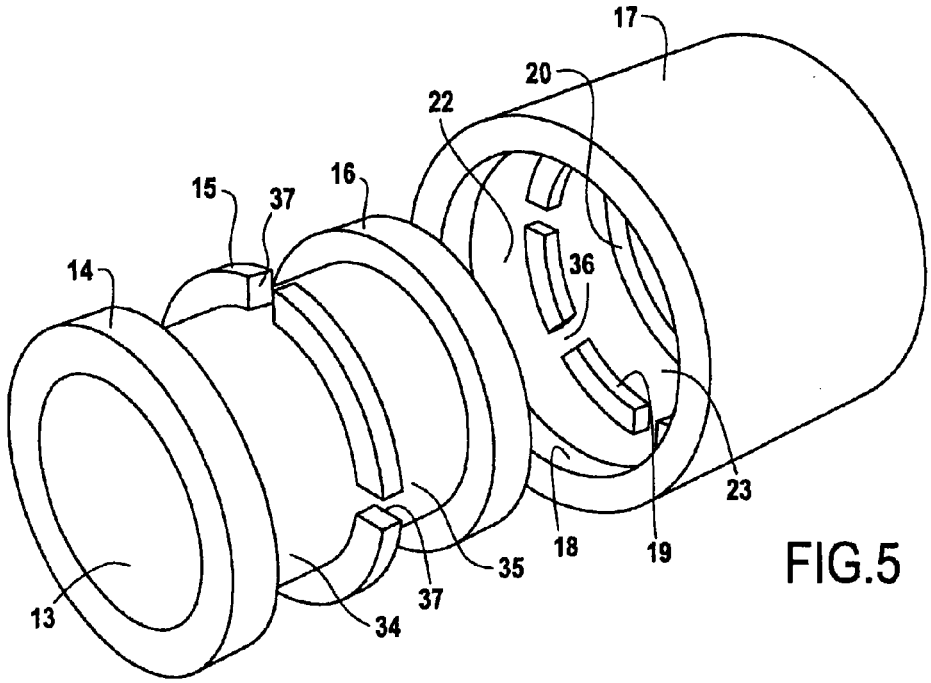
FIG. 5 is an exploded perspective view of the magnetic circuit of the transformer of FIGS. 3 and 4.

FIG. 5 is an exploded perspective view of the magnetic circuit of the transformer 10.

Figure 6:
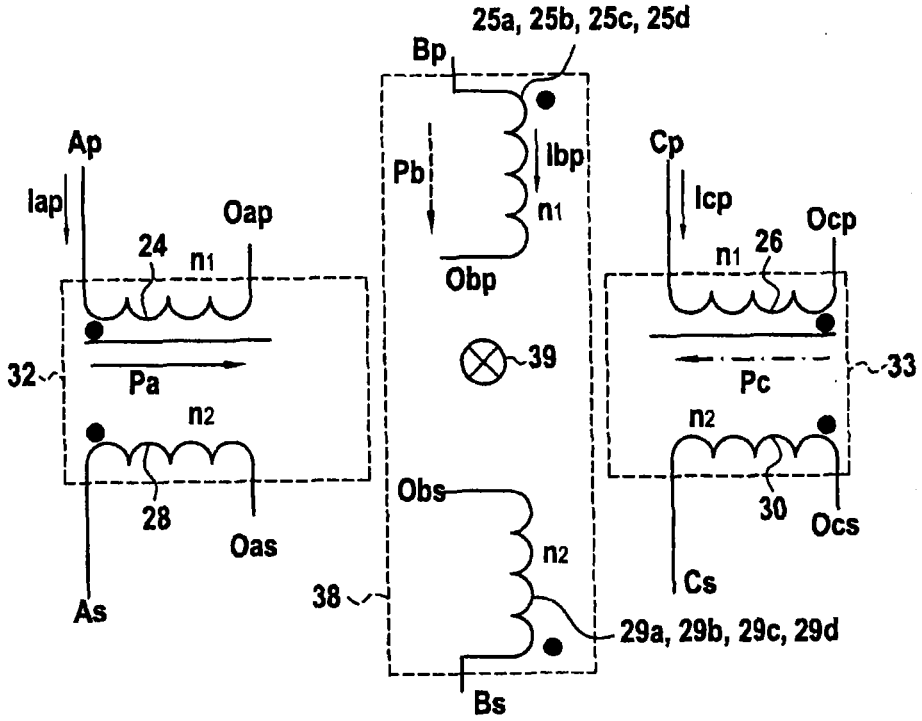
FIG. 6 is an electrical circuit diagram showing the connections of the coils in the transformer of FIGS. 3 and 4.

With reference to FIG. 6, there follows an explanation of how the transformer 10 operates. In FIG. 6, the following notation is used:

- $A_p$, $B_p$, and $C_p$, are the inlet points of the primary coils of the transformer 10. The phases U, V, and W of FIG. 3 correspond respectively to the phases A, B, and C of FIG. 6, but all other types of correspondence are possible providing the same correspondence is used for the secondary.
- $I_{ap}$, $I_{bp}$, and $I_{cp}$ are the respective incoming currents at the points $A_p$, $B_p$, and $C_p$.
- $O_{ap}$, $O_{bp}$, and $O_{cp}$ are the connection points making possible electrical couplings identical to all kinds of static three-phase transformer (star-star, star-delta, delta-delta, delta-star, zigzag, . . . ).
- Black dots show the relationship between the current flowing in a coil and the direction of the corresponding magnetic potential.
- Pa, Pb, and Pc are the magnetic potentials in the cores 32, 38, and 33 corresponding respectively to the currents $I_{ap}$, $I_{bp}$, and $I_{cp}$;
- $A_s$, $B_s$, $C_s$, $O_{as}$, $O_{bs}$, and $O_{cs}$, are the outlet points and the points for connection to the secondary.

As shown in FIG. 6, for the current $I_{ap}$, the coil 24 corresponds to an axial magnetic potential Pa directed to the right in the magnetic core 32. The coils 25*a*, 25*b*, 25*c*, and 25*d* correspond, for a current $I_{bp}$, to a radial magnetic potential Pb directed downwards in the magnetic core 38. Finally, for the current $I_{cp}$, the coil 26 corresponds to an axial magnetic potential Pc directed to the left in the magnetic core 33. The magnetic potentials Pa, Pb, and Pc are equal in modulus and opposite in direction on each magnetic core and they are symmetrical relative to the point of symmetry 39 situated at the intersection of the three cores.

In a variant that is not shown, the winding directions of the coils and/or their connection points are different, such that the magnetic potentials Pa, Pb, and Pc are in the opposite directions compared with the example shown.

This configuration enables fluxes to be properly coupled. More precisely, the topology of the transformer 10 makes it possible to obtain a coupling coefficient of 3/2.

In the embodiment shown, the transformer 10 has four primary coils 25*a* to 25*d* in series, and four secondary coils 29*a* to 29*d* in series. In a variant, the number of coils on the central column could be greater or smaller. There may be different numbers of coils on the central column for the primary and for the secondary.

In the example shown, the slots 36 & 37 are arranged in the central column (legs 15 & 19). The coils of 25*a* to 25*d* and 29*a* to 29*d* thus surround of the central column and the magnetic core 38 is situated in the central column. In a variant that is not shown, the slots 36 and 37 are arranged in one of the side columns (legs 14 & 18 or 16 & 20). The coils 25*a* to 25*d* and 29*a* to 29*d* thus surround one of the side columns and the magnetic core 38 is situated in this side column. Nevertheless, such a variant is not magnetically shielded.

The transformer 10 presents several advantages.

In particular, it can be seen that the magnetic circuit completely surrounds the coils 24 to 30. The transformer 10 is thus magnetically shielded. Furthermore, some of the coils 24 to 30 are toroidal coils of axis A. The transformer 10 thus makes it possible to use coils of simple shape.

Furthermore, the phases of the transformer 10 may be balanced in inductance and in resistance.

In order to obtain the theoretical coupling coefficient and three-phase balance, it suffices for the reluctances between the midpoint of the ring 17 and the midpoint of the ring 13 and passing via each of the columns to be identical.

If the airgap creates reluctances that are large compared with the reluctances of the rings 13 and 17, then the reluctances of the rings can be ignored, and it is therefore possible to obtain partial balancing for columns having the same reluctance. The magnetic circuit can then be particularly simple to design.

One possible improved embodiment enabling a better balance to be obtained is to increase the reluctance of the central column a little so as to compensate for the unbalance in the reluctances due to the secondary reluctances (reluctance of the ring, reluctance of the legs, . . . ). To do this, it is possible among other things to reduce the width of the central column a little or to increase the airgap in the central column a little compared with the other columns.

Account must also be taken of the reluctance of the slots 36 and 37.

Finally, the transformer 10 presents reduced weight and volume.

Figure 1:
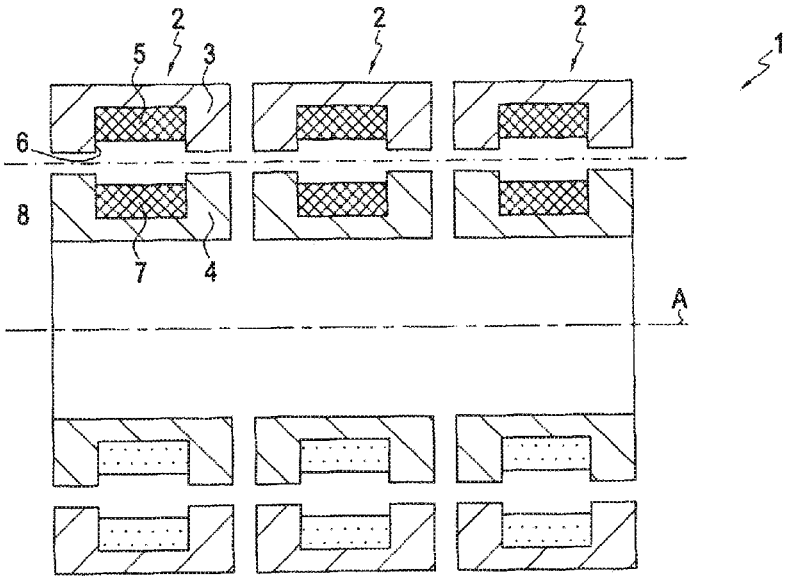
FIG.1 Background Art
FIGS. 1 and 2 are section views of respective prior art rotary three-phase transformers.
Figure 2:
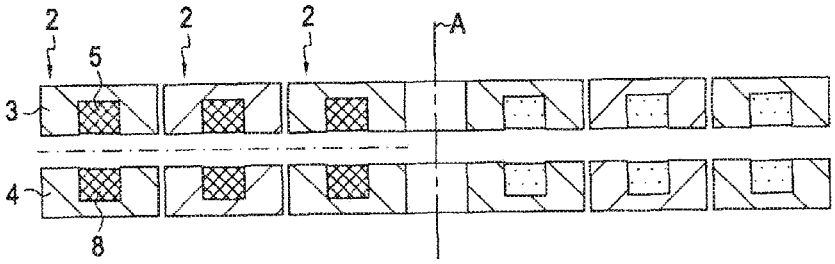
FIG.2 Background Art

Specifically, if the transformer 10 is compared with the transformer 1 of FIG. 1 or FIG. 2, and assuming it is designed to provide the same performance, the following assumptions can be made:

- Conductive material: Let Q be the quantity of conductive material in a coil of one of the three single-phase transformers of the transformer 1. The quantity of conductive material in the coils of the transformer 1 is thus 3Q.
- Magnetic material: If the same reluctance Re is concerned for each column, each single-phase transformer of the transformer 1 has an overall reluctance of the magnetic circuit close to 2Re. For the transformer 10, the overall reluctance of the magnetic circuit is close to (3/2)Re.

For the transformer 10, with the same magnetizing current and the same number of turns $n_1$ as for the transformer 1, the induction field and the flux is thus doubled. Specifically, for the transformer 1, the multiplying coefficient is 0.5 (i.e. the coupling coefficient=1 divided by the reluctance ratio=2) and for the transformer 10 with linked fluxes the modifying coefficient is 1 (i.e. the coupling coefficient=3/2 divided by the reluctance ratio=3/2). The ratio is thus indeed equal to 2 (1/0.5). This property makes it possible to evaluate approximately the possibilities for optimizing the transformer 10 relative to the transformer 1, for the same performance.

It is decided to reduce the number of turns by √2, thereby giving rise to an increase in the induction field of √2, while making it possible to have the same voltage for the same magnetizing current.

For a design having the same losses in joules and the same phase resistance, this gives:

For the coil 24, there need to be √2 fewer turns, and thus the quantity of conductive material is Q/√2. For constant losses in joules, the resistance (ρl/S) is also divided by √2 (length divided by √2), so in order to conserve losses in joules it is possible to divide the section by √2 for the same load current, magnetizing current, and voltage (in practice the saving might not be so great, since it is necessary to avoid local overheating, which depends on thermal conduction). The quantity of conductive material for the coil 24 is thus Q/2. The same reasoning applies to the coil 26.

For the coils 25*a*, 25*b*, 25*c* and 25*d*, there need to be √2 fewer turns, and thus the quantity of conductive material is 2*Q/√2=√2*Q. At constant losses in joules, since the length is multiplied by √2 relative to a U-shaped single-phase transformer, the section is multiplied by √2. Consequently, these coils require a quantity of conductive material equal to 2Q.

For constant phase resistance for the transformer 10, the overall quantity of conductive material is thus: Q/2+2Q+Q/2=3*Q. For the transformer 1, the quantity of conductive material was 3*Q, i.e. the same quantity. By way of comparison, for a static three-phase transformer, the quantity of conductive material is 3Q/2.

Concerning iron losses, in spite of the increase in the induction field B, it is assumed that its increase by √2 makes it possible to remain within non-saturated conditions (the high reluctance of the airgap favors designing the transformer 10 with a weak induction field in the magnetic material, it being necessary to increase the area of the airgap in order to decrease its reluctance, and that requires the area of magnetic material to be increased).

Losses by hysteresis are given by $K_H B^2 f^* V$ and current losses are given by $K_F B^2 f^2 * V$, with:

V: volume;

f: utilization frequency;

B: maximum induction field;

$K_H$: a constant associated with the magnetic materials and with the structure of the magnetic circuit; and $K_F$: a constant associated with the magnetic materials and with the structure of the magnetic circuit.

Losses are thus twice as great per unit volume when transposing the standard rotary transformer 1 to the three-phase transformer 10 with forced flux ($(\sqrt{2}B)^2=2B^2$).

If the saving in volume of the magnetic circuit is evaluated, it can be estimated that the volume is decreased by about 42%, which means that there is an overall increase of about 16% for iron losses (0.58*2=1.16). This naturally depends on the initial dimensioning. With a rotary transformer, iron losses are much less than joule losses and it can thus be considered that the increase in overall losses (less than 8%) is negligible.

Figure 7:
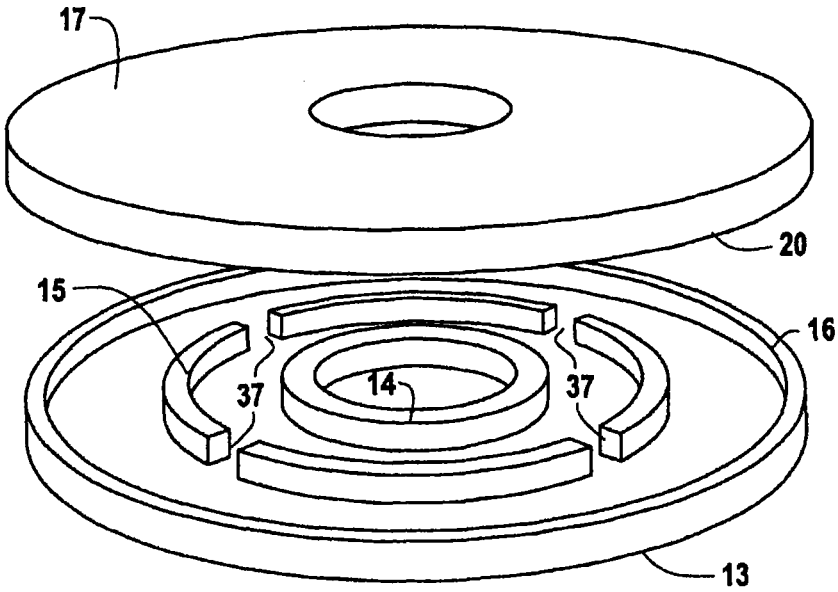
FIG. 7 is an exploded perspective view of a magnetically shielded three-phase rotary transformer with forced linked fluxes in a second embodiment of the invention.

FIG. 7 shows the magnetic circuit of a transformer (not shown) in a second embodiment. The transformer may be considered as being an "E-shaped" or a "pot-shaped" variant of the "U-shaped" transformer 10 of FIG. 3. The same references are therefore used as in FIG. 7 and in FIG. 3, without risk of confusion, and a detailed description of the transformer in the second embodiment is omitted. It is merely stated that the references 13 and 17 correspond to two axially spaced-apart rings, the legs 14 to 16 and 18 to 20 extending axially between the two rings 13 and 17, and that the magnetic cores in this example are situated in the columns.

Figure 8:
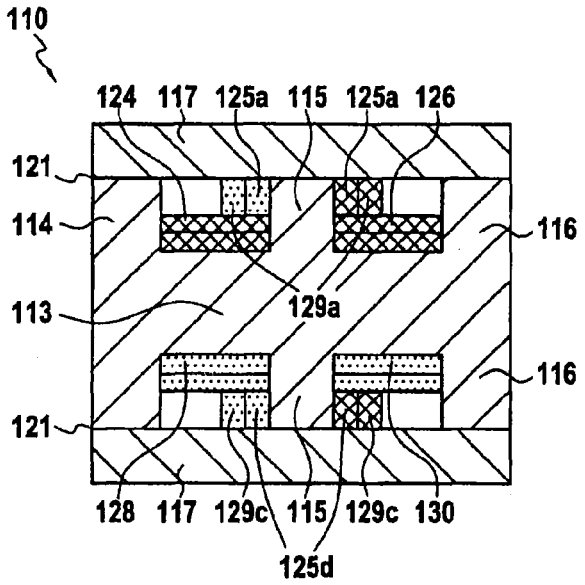
FIG. 8 is a section view of a magnetically shielded three-phase static transformer with forced linked fluxes in a third embodiment of the invention.

FIG. 8 shows a transformer 110 in a third embodiment of the invention. The transformer 110 may be considered as a static transformer corresponding to the rotary transformer 10 of FIG. 3. In FIG. 8, the same references are therefore used as in FIG. 3, plus 100, in order to designate elements that are identical or similar to those of FIG. 3.

The transformer 110 has a ring 113 about the axis A, three legs 114, 115, and 116, and a ring 117 of ferromagnetic material about the axis A. Each of the legs 114, 115, and 116 extends radially away from the axis A, starting from the ring 113. The leg 114 is at one end of the ring 113, the leg 116 is at another end of the ring 113, and the leg 115 lies between the legs 114 and 116. The ring 117 surrounds the ring 113 and the legs 114 to 116, defining an airgap 121.

The rings 113 and 117 together with the legs 114 to 116 form a three-column magnetic circuit of the transformer 110. More precisely, the magnetic circuit of the transformer 110 has a first column (corresponding to the leg 114), a second column (corresponding to the leg 115), and a third column (corresponding to the leg 116).

The magnetic circuit of the transformer 110 defines a slot 122 between the two rings, the first column, and the second column, and a slot 123 between the two rings, the second column, and the third column.

As shown in FIG. 8, the transformer 110 has coils 124, 125*a*, 125*d* (together with two coils not shown), 126, 128, 129*a*, 139*c* (together with two coils not shown), and 130 corresponding to the coils 24 to 30 of the transformer 10.

The transformer 110 is a magnetically shielded three-phase static transformer with forced linked fluxes, and with a three-column magnetic circuit. It presents operation and advantages similar to the transformer 10 of FIG. 3.

Figure 9:
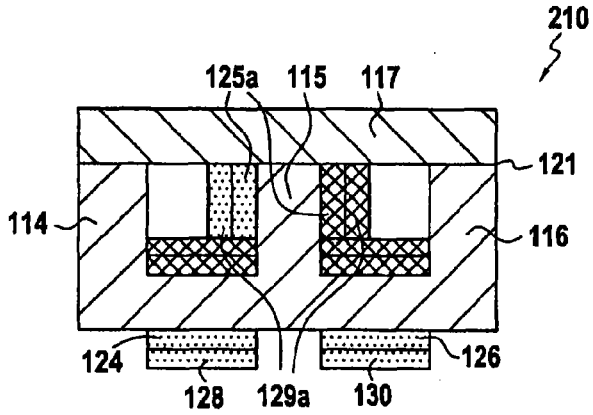
FIG. 9 is a section view of a magnetically shielded three-phase rotary transformer with forced linked fluxes in a fourth embodiment of the invention.

FIG. 9 shows a transformer 210 in a fourth embodiment of the invention. The transformer 210 may be considered as being a magnetically non-shielded variant of the magnetically shielded transformer 110 of FIG. 8. The same references are therefore used as in FIG. 9 and in FIG. 8, without risk of confusion, and a detailed description of the transformer 210 is omitted. It is merely stated that the magnetic circuit of the transformer 210 does not completely surround of the coils 124, 128, 126, and 130, and that the transformer 210 is therefore not magnetically shielded, unlike the transformer 110.

Figure 10:
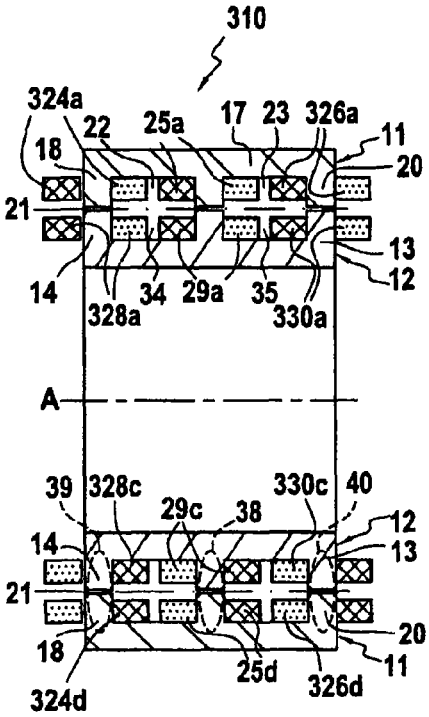
FIG. 10 is a section view of a three-phase rotary transformer with forced linked fluxes in a first embodiment useful for understanding the invention.

FIG. 10 is a section view of a transformer 310 in a first embodiment useful for understanding the invention. The transformer 310 may be considered as a three-phase rotary transformer with forced linked fluxes, and it may be considered as a variant of the transformer 10 of FIG. 3. Thus, in FIG. 10, (and in FIGS. 11 to 13), elements that are identical or similar to elements of the transformer 10 of FIG. 3 are designated by the same references, without risk of confusion. Below, the specific features of the transformer 310 are described in detail.

Instead of the toroidal coil 24, the transformer 310 has four coils, of which a coil 324*a* and a coil 324*d* are shown in FIG. 10, these coils are connected in series and are received in slots 436 formed in the leg 18 (the slots 36 can be seen in FIG. 11). In corresponding manner, instead of the toroidal coil 28, the transformer 310 has four coils, of which a coil 328*a* and a coil 328*d* are shown in FIG. 10, these coils are connected in series and are received in slots 37 formed in the leg 15.

Likewise, instead of the toroidal coil 26, the transformer 310 has four coils, of which a coil 326*a* and a coil 326*d* are shown in FIG. 10, these coils are connected in series and are received in slots 36 formed in the leg 20. In corresponding manner, instead of the toroidal coil 30, the transformer 310 has four coils, of which a coil 330*a* and a coil 330*d* are shown in FIG. 10, these coils are connected in series and are received in slots 37 formed in the leg 16.

In other words, in similar manner to the central phase, the side phases are no longer wound around the axis of rotation A, but radially around each of the columns. The transformer 310 thus has three radial magnetic cores: A core 38 in the central column formed by the legs 15 and 19, a core 39 in the column formed by the legs 14 and 18, and a core 40 in the column formed by the legs 16 and 20.

FIG. 12 uses the same notation as FIG. 6 and illustrates the operation of the transformer 310.

In FIG. 12, the coils 324*a*, 324*d*, and the coils that are not shown and that are connected thereto correspond, for a current $I_{ap}$, to a radial magnetic potential Pa directed towards the axis A in the magnetic core 39. Likewise, the coils 25*a*, 25*b*, 25*c*, and 25*d* correspond, for a current $I_{bp}$, to a radial magnetic potential Pb directed towards the axis A in the magnetic core 38. Finally, the coils 326*a*, 326*d*, and the coils that are not shown and that are connected thereto correspond, for a current $I_{cp}$, to a radial magnetic potential Pc directed towards the axis A in the magnetic core 40.

The magnetic potentials Pa, Pb, and Pc are equal in modulus, and they are all directed towards the axis A. In a variant that is not shown, the magnetic potentials Pa, Pb, and Pc are in the direction opposite relative to the example shown, i.e. they are all directed away from the axis A.

This configuration enables fluxes to be properly coupled. More precisely, the topology of the transformer 310 makes it possible to obtain the same coupling coefficient of 3/2 as in the above-described transformer 10. In order to obtain the theoretical coupling coefficient and three-phase balance, it suffices for the reluctances between the midpoint of the ring 17 and the midpoint of the ring 13 and passing via each of the columns to be identical.

The transformer 310 presents the same advantages as the transformer 10, other than using only toroidal coils. In particular, the transformer 310 makes it possible to obtain coupling of the phases that enables the multiplicative coefficient of 3/2 to be obtained.

In the embodiment shown, the transformer 310 comprises, for each phase, four primary coils in series (coils 25*a* to 25*d* for the central phase) and four secondary coils in series (coils 29*a* to 29*d* for the central phase). In a variant, the number of coils on each column could be greater or smaller. There may be different numbers of coils on each column for the primary and for the secondary.

Figure 13:
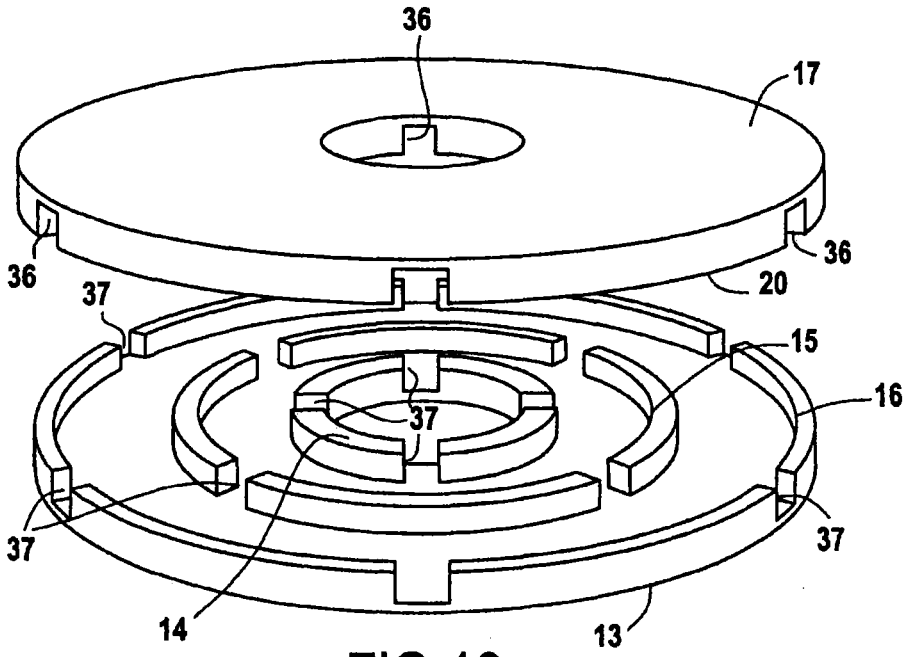
FIG. 13 is an exploded view in perspective of the magnetic circuit of a transformer in a second embodiment useful for understanding the invention, that may be considered as being a variant of the FIG. 10 transformer.
Figure 14:
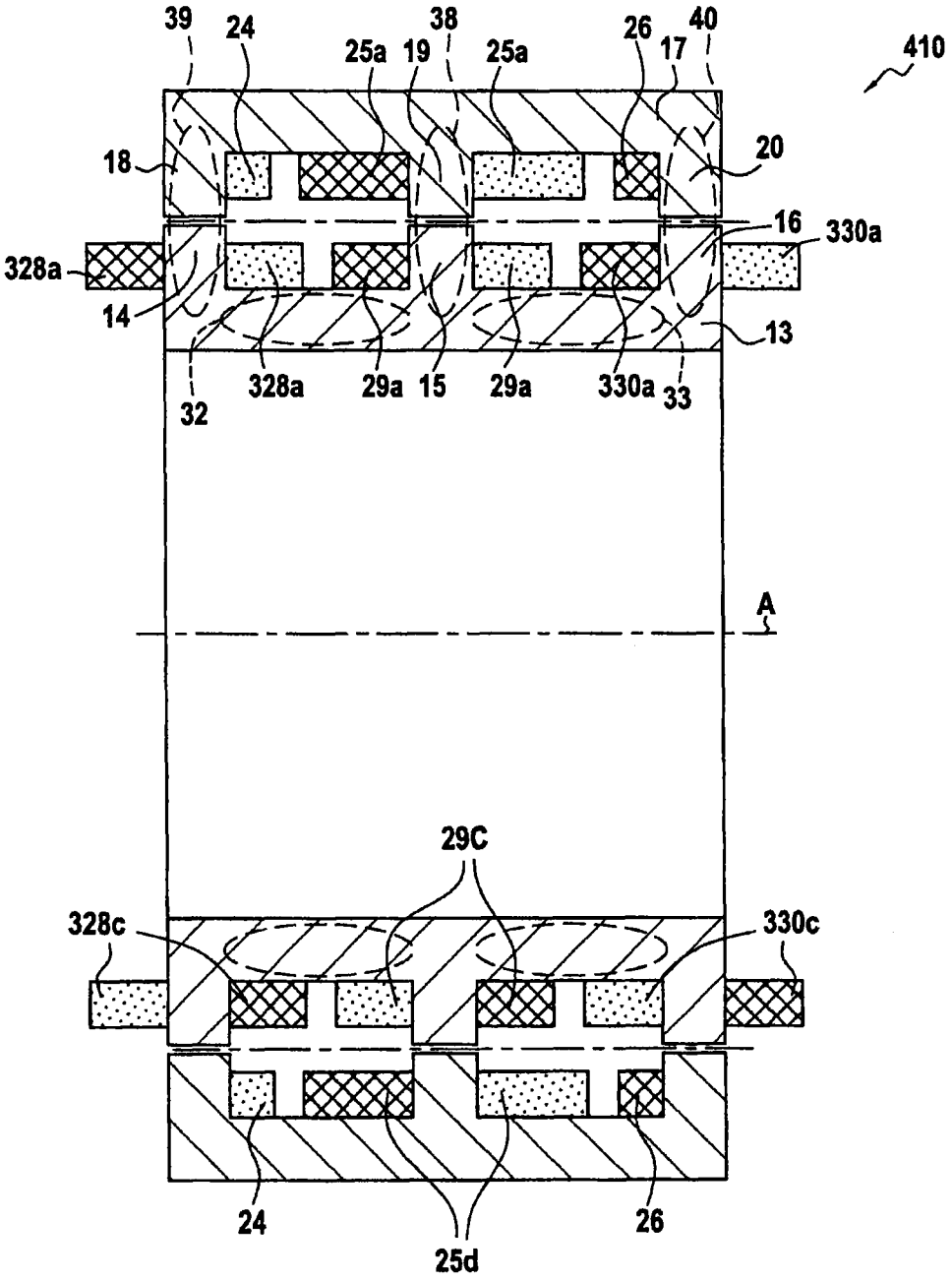
FIG. 14 is a section view of a rotary transformer with forced linked fluxes in a fifth embodiment of the invention.

The transformer 310 shown in FIGS. 10 to 12 is a "U-shaped" transformer. In a variant that is not shown, an "E-shaped" or a "pot" transformer would present similar topology. Under such circumstances, the magnetic cores would be axial. FIG. 13 shows, in an exploded perspective view, a magnetic circuit suitable for making such an "E-shaped" variant. Elements corresponding to elements of FIG. 11 are designated by the same references, without risk of confusion.

In the transformer 10 of FIG. 3, and in the transformer 310 of FIG. 10, the coils enable three-phase fluxes to be reproduced in the three columns of the transformer in a manner that is equivalent to a three-phase static transformer with forced linked fluxes. Likewise, in the "E-shaped" variants of the transformer (not shown but based on the magnetic circuit of FIG. 7 or FIG. 13 respectively), the coils enable three-phase fluxes to be reproduced in the three columns of the transformer in a manner that is equivalent to a three-phase static transformer with forced linked fluxes.

Thus, the primaries and the secondaries of these transformers are compatible. In general manner, the primary of the transformer 10 is compatible with any secondary of topology making it possible to reproduce the three-phase fluxes in the three columns in a manner that is equivalent to a three-phase static transformer with forced linked fluxes. Thus, in the transformer 10, the primary and the secondary are made on the same principle. Nevertheless, in a variant, the primary or the secondary could be made on a different principle, e.g. on the principle of the transformer 310 of FIGS. 10 to 12.

FIG. 15 is a section view of a transformer 410 in a fifth embodiment of the invention, using the primary of the transformer 10 and the secondary of the transformer 310. In FIG. 15, the same references are therefore used as in FIG. 3, or in FIG. 10, and a detailed description is omitted.

In known manner, a transformer may have a plurality of secondaries. Thus, in an embodiment not shown, the coils of each secondary may be made simultaneously using the principle of the transformer 10 and the principle of the transformer 310 on a common body, providing it possesses the necessary slots in its legs for passing coils using the principle of the transformer 310.

The invention claimed is:

1. A three-phase three-column transformer including a primary portion and a secondary portion and a common symmetry axis A;

the primary portion comprising a first body made of ferromagnetic material and primary coils, the secondary portion comprising a second body made of ferromagnetic material and secondary coils;

the first body defining a first annular slot of axis A and a second annular slot of axis A, the first slot being defined by a first side leg, a central leg, and a ring, the second slot being defined by the central leg, a second side leg, and the ring;

the primary coils comprise a first toroidal primary coil of axis A corresponding to a phase Up of the transformer in the first slot, a second toroidal primary coil of axis A corresponding to a phase Wp of the transformer in the second slot, and one or more third toroidal primary coils connected in series, the third toroidal primary coils corresponding to a phase Vp of the transformer being wound around one of the legs and passing via slots in the one of the legs.

2. A transformer according to claim 1, wherein the third toroidal primary coils are wound around the central leg.

3. A transformer according to claim 1, wherein the primary portion and the secondary portion are movable in rotation relative to each other about the axis A.

4. A transformer according to claim 3, wherein the second body defines a first annular secondary slot of axis A and a second annular secondary slot of axis A, the first secondary slot being defined by a first secondary side leg, a secondary central leg, and a secondary ring, the second secondary slot being defined by the secondary central leg, a second secondary side leg, and the secondary ring;

the secondary coils comprise a first toroidal secondary coil of axis A corresponding to a phase Us of the transformer in the first secondary slot, a second toroidal secondary coil of axis A corresponding to a phase of the transformer in the second secondary slot, and one or more third toroidal secondary coils connected in series, the third toroidal secondary coils corresponding to a phase Vs of the transformer being wound around one of the secondary legs and passing via slots in the ont of the secondary legs.

5. A transformer according to claim 4, wherein the first side leg and the first secondary side leg are in line with each other and separated by an airgap, the central leg and the secondary central leg are in line with each other and separated by an airgap, and the second side leg and the second secondary side leg are in line with each other and separated by an airgap.

6. A transformer according to claim 3, wherein the primary portion surrounds the secondary portion relative to the axis A, or vice versa.

7. A transformer according to claim 3, wherein the primary portion and the secondary portion are situated one beside the other in the direction of the axis A.

8. A transformer according to claim 1, wherein t primary portion and the secondary portion are stationary relative to each other.

9. A transformer according to claim 1, wherein the first and second bodies made of ferromagnetic material completely surround the primary and the secondary coils.

* * * * *